United States Patent [19]

Babler

[11] Patent Number: 4,726,463

[45] Date of Patent: Feb. 23, 1988

[54] TRANSPORT INSTALLATION, STEP MEMBER EQUIPPED WITH PROTECTIVE PROJECTING STEP EDGES, AND METHOD OF PROTECTING LATERAL EDGES OF A TRANSPORT INSTALLATION

[75] Inventor: Walter Babler, Perchtoldsdorf, Austria

[73] Assignee: Inventio AG, Hergiswil, Switzerland

[21] Appl. No.: 890,178

[22] Filed: Jul. 28, 1986

[30] Foreign Application Priority Data

Aug. 6, 1985 [CH] Switzerland ..... 3360/85

[51] Int. Cl.[4] ..... B66B 9/12

[52] U.S. Cl. ..... 198/333

[58] Field of Search ..... 198/333

[56] References Cited

U.S. PATENT DOCUMENTS

| | | | |
|---|---|---|---|
| 2,981,397 | 4/1961 | Hansen | 198/325 |
| 3,986,595 | 10/1976 | Asano et al. | 198/333 |
| 4,470,497 | 9/1984 | Kraft | 198/333 |
| 4,570,781 | 2/1986 | Kappenhagan | 198/333 |
| 4,638,901 | 1/1987 | Lunardi | 198/333 X |

FOREIGN PATENT DOCUMENTS

| | | |
|---|---|---|
| 0087692 | 9/1983 | European Pat. Off. . |
| 2346266 | 3/1975 | Fed. Rep. of Germany . |

*Primary Examiner*—James A. Leppink
*Assistant Examiner*—Matthew Smith
*Attorney, Agent, or Firm*—Werner W. Kleeman

[57] ABSTRACT

In transport installations, particularly escalators, a latent danger of jamming exists between a moving step and the stationary skirt panels mounted laterally near the steps, above all for flimsy footwear. In the escalator step according to the invention, throughout a danger zone coinciding with the precursive level run of an escalator step run, a tread edge member laterally adjacent each step is positively shifted upwards by a certain amount. In a return run of the escalator step run, this tread edge member is held by a spring force in a position lying flush with a tread surface of the step. The relative motion occurring between each step and a traction member for forming a constantly horizontally running tread surface of the step in the precursive level run of the escalator step run, results also in an angular displacement between an escalator step body of the escalator step and a cam or crank arm connected with a pivot axis of the traction member. This angular displacement is exploited for actuating the lateral tread edge members in that an entrainment pin or crank pin mounted on the cam or crank arm actuates a rocker arm pivoted on the step body. In turn the rocker arm appropriately moves the tread edge member upwards and downwards.

7 Claims, 5 Drawing Figures

TRANSPORT INSTALLATION, STEP MEMBER EQUIPPED WITH PROTECTIVE PROJECTING STEP EDGES, AND METHOD OF PROTECTING LATERAL EDGES OF A TRANSPORT INSTALLATION

BACKGROUND THE INVENTION

The present invention broadly relates to passenger transport installations, especially escalators and, more specifically, pertains to a new and improved construction of an escalator step and also pertains to a new and improved method of protecting lateral edges of transport installations.

In the context of this disclosure, the term escalator step refers to any support member for the transport of passengers or articles by means of a sequential train of such support members. A preferred application of the inventive step member is in passenger escalators.

In its more particular aspects, the invention relates to an escalator step of an escalator step run comprising a plurality of escalator steps and two continuous transporting or traction means, which escalator step run is guided between two stationary skirt panels and which escalator step possesses tread edge members protruding or projecting beyond, i.e. above, the tread surface on both lateral sides.

It is known that in escalators, a latent danger of jamming prevails, above all for flimsy footwear, between the moving step and the stationary skirt panel. Jamming accidents usually arise then when a passenger stands laterally so close to a limit of the tread surface of the step that a shoe brushes against the stationary skirt panel mounted laterally of the step. In addition to the thus resulting friction counter to the direction of travel, at the locations where the step risers either retract or deploy, there arises a relative motion transverse to the direction of travel resulting in friction transverse to the direction of travel. This motion and the therewith associated friction arise at either the upper or the lower transition or landing region of the escalator, depending on the direction of travel. This motion can draw flimsy footwear in between the moving step and the stationary skirt panel.

In other words, the present invention relates to a step or step member for an escalator in which an escalator step run comprising a plurality of such step members and two continuous traction means is guided between two stationary skirt panels. The step member comprises a step body having a tread surface, two lateral sides and at least one lateral side wall. The step body is provided with a respective tread edge member arranged at each of the two lateral sides and projecting above the tread surface.

Expressed in a different manner, the step or step member of the present invention is for a transport means, especially passenger transport means such as escalators and moving sidewalks or walkways. The step member comprises a step body having a substantially horizontal tread surface and two lateral walls. The step body is provided with a tread edge member arranged at least at one of the two lateral walls for performing extension and retraction motions relative to the step body such that each tread edge member projects above the substantially horizontal tread surface in an extended position thereof and such that each tread edge member is substantially flush with the substantially horizontal tread surface in a retracted position thereof.

The present invention also relates to a transport means, especially a passenger transport means such as an escalator or a moving sidewalk or walkway. The transport means comprises continuously circulating traction means having a predetermined path of travel. The continuously circulating traction means comprise chain wheel axles extending transverse to the predetermined path of travel and each having two ends. The continuously circulating traction means comprises link members extending substantially parallel to the predetermined path of travel and each having a first end and a second end. A respective link member of the link members is attached to each end of the two ends of each chain wheel axle and fixed against rotation relative thereto.

The method of the present invention is for protecting the lateral edges of transport means comprising step members and continuous traction means having discrete link members, especially passenger transport means such as escalators and moving sidewalks or walkways. The method comprises the steps of providing each step member with a tread edge member arranged at least at one of two lateral walls of the step member for performing extension and retraction motions relative to the step member such that each tread edge member projects above the substantially horizontal tread surface in an extended position thereof and such that each tread edge member is substantially flush with the substantially horizontal tread surface in a retracted position thereof.

Various developments have become known by means of which it has been tried and is still being tried to obviate the danger set forth above. One of these developments which is known from the U.S. Pat. No. 4,236,623, granted Dec. 2, 1980 consists in raising the lateral portions of the step tread or surface by wedging a plastic profile or rib into the outermost two grooves of the tread so that this portion of the step is rendered uncomfortable to escalator users such that they will stand on the planar tread surface adjacent this raised rib. The wedged plastic profile or rib additionally possesses a gentle inclination on the surface facing away from the skirt panel. A shoe nevertheless brought to bear on this location also assumes a slight inclination or canting. If the shoe also simultaneously bears against the skirt panel, a portion of the ensuing horizontal force will be taken up by the raised step edge and the friction on the skirt panel and thus the danger of drawing the shoe in between the step edge and the skirt panel is reduced.

A further development of this nature is known from the U.S. Pat. No. 4,413,719, granted Nov. 8, 1983 in which, inter alia, plastic components are set in a guiding fashion on the lateral tread sides which slidingly bear against the skirt panel. The plastic components possess a low coefficient or friction and fully take up the play between the step and the skirt panels, thus greatly reducing the danger of flimsy footwear being drawn in.

However, both inventions have the disadvantage that the raised side portions of the steps or treads require more lateral space when running through the upper and lower comb plates and the danger of jamming is substantially increased when running into a comb plate when a wedged plastic component loosens during the course of time or is missing from the step tread for any reason.

SUMMARY OF THE INVENTION

Therefore, with the foregoing in mind, it is a primary object of the present invention to provide a new and improved construction of a support member or step member for a transport means which does not exhibit the aforementioned drawbacks and shortcomings of the prior art constructions.

Another and more specific object of the present invention aims at providing a new and improved construction of an escalator step or step member of the previously mentioned type in which the step or step member reduces the danger of jamming between the steps and the skirt panels and requires no additional space when running through comb plates and with which no additional danger of jamming can arise when running through a comb plate.

Yet a further significant object of the present invention aims at providing a new and improved construction of an escalator step or step member of the character described which is relatively simple in construction and design, extremely economical to manufacture, highly reliable in operation, not readily subject to breakdown or malfunction and requires a minimum of maintenance and servicing.

Now to implement these and still further objects of the invention, which will become more readily apparent as the description proceeds, the construction of the present invention is manifested by the features that the projecting tread edge member is movably located and is held in a protruding or projecting safety position throughout a danger zone against a spring force by a cam or crank arm mounted on a pivot pin of a transporting medium or traction means and by an actuation means mounted on a lateral or side plate or wall of a step body and is pressably retractable outside the limits of the danger zone by the spring force into a position lying flush to the tread or step surface of the step or step member.

In other words, the step member of the present invention is manifested by the features that each projecting tread edge member of the respective tread edge members is movably mounted. The step member comprises a spring means capable of exerting a force. The step member is subject to passage through a danger zone and defines a projecting safety position for the tread edge member. The continuous transport or traction means has at least one pivot pin. Respective cam means are mounted on each at least one pivot pin. A respective actuation means is mounted on each at least one side wall. The tread surface defines a flush position for the respective tread edge members. The respective cam means and the respective actuation means hold each projecting tread edge member in the projecting safety position counter to the force within the danger zone. Each projecting edge member is depressable into the flush position beyond the danger zone.

Expressed differently, the step member is manifested by the features that spring means are arranged between the step body and the tread edge members for biasing the tread edge members into the retracted position. A chain wheel axle is journaled in the step body and is fixedly connected to a traction means of the transport means. The step member is provided with actuation means responsive to angular displacement of the chain wheel axle relative to the step body for selectively placing the tread edge members in the extended position during a predetermined portion of a path of travel of the transport means.

The transport means of the present invention is manifested by the features that entrainment means are attached to each of the chain wheel axles and fixed against rotation relative thereto. The transport means comprises step members each comprising a step body having a tread surface and two lateral walls and pivotably journaled on an associated chain wheel axle of the chain wheel axles. The transport means comprises means for supporting and guiding the step members in the predetermined path of travel. Each step member is provided with a tread edge member arranged at least at one of the two lateral walls of the step member for performing extension and retraction motions relative to the step member such that each tread edge member projects above a tread surface of the step member in an extended position thereof and such that each tread edge member is substantially flush with the tread surface in a retracted position thereof. Each step member comprises spring means arranged between the step member and the tread edge members for biasing the tread edge members into the retracted position. Each step member comprises actuation means for engaging the entrainment means of the associated chain wheel axle for selectively placing the tread edge members in the extended position during a predetermined portion of the predetermined path of travel of the transport means in response to an angular displacement of the chain wheel axle relative to the step member.

The method of the present invention is manifested by the features that it comprises the steps of exploiting an angular displacement of at least one member, such as a link member of the discrete link members to actuate the tread edge member.

The advantages achieved by the invention consist substantially in that at least one movably located tread edge member substantially corresponding to a rib on the step body is raised and then retracted again on each step in the region of the lateral danger zones before running through the comb plate, i.e. during the transition from the lower or from the upper precursive level or substantially horizontal path or landing region to the inclined path or stair region and along the inclined path between the step body and the skirt panel. By raising these lateral ribs or tread edge members, a shoe or other object already gliding along the skirt panel in the region of the horizontal path will be forced upwards and the frictional force on the skirt panel simultaneously reduced. It is, however, more likely that the passenger will step away from the danger as soon as the raising of the foot by the lateral tread edge member is perceived. An already raised lateral tread edge member makes it difficult for the passenger to press the foot or the shoe against the skirt panel during travel. The tread edge member translatably connected with the step body cannot be improperly removed from the step body without damage. A further great advantage also consists in that an escalator step run having the inventive steps or step members can be incorporated into an existing escalator without any significant alterations having to be undertaken on the escalator.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
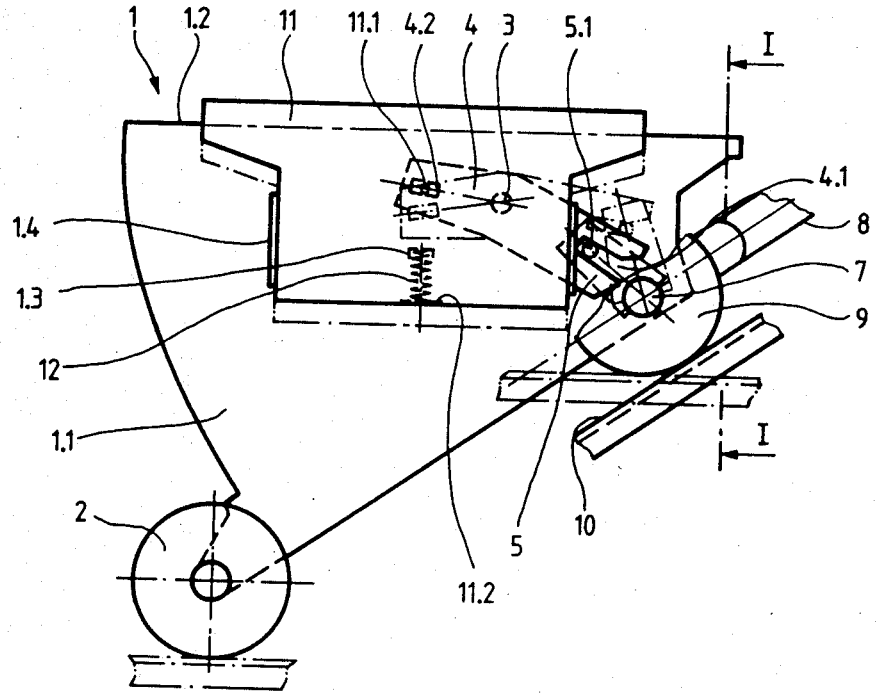
FIG. 1 schematically illustrates a side view of a step having a projecting tread edge member on the outer side of the step.
Figure 2:
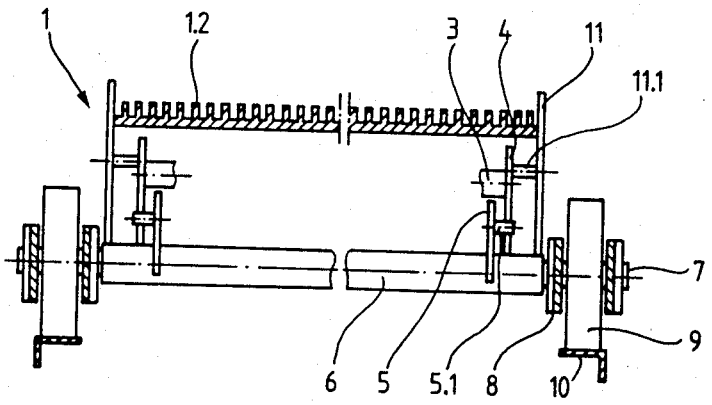
FIG. 2 schematically illustrates a section through the escalator step run taken along the line I—I in FIG. 1.

Describing now the drawings, it is to be understood that to simplify the showing thereof only enough of the structure of the escalator step or step member has been illustrated therein as is needed to enable one skilled in the art to readily understand the underlying principles and concepts of this invention. Turning now specifically to FIGS. 1 and 2 of the drawings, the step member illustrated therein by way of example and not limitation will be seen to comprise a step body for an escalator labeled with the reference numeral 1. A drag wheel or roller 2 is rotatably positioned at a lateral or side plate or wall 1.1 of the step body 1. A journal 3 for pivotably mounting a rocker arm 4 is mounted on the same lateral or side plate or wall 1.1. One end of the rocker arm 4 possesses an open-ended guide slot 4.1 and the other end possesses a closed guide slot 4.2. An entrainment pin or crank pin 5.1 mounted on a cam or crank arm 5 engages the open-ended guide slot 4.1. The cam or crank arm 5 is fixedly connected with a pivot pin 7 of a traction member 8 either directly or through a chain wheel axle or stepped axle 6. The traction member 8 may, for instance, comprise a chain structure having discrete link members as generally indicated in FIG. 2. The pivot pin 7 may, for instance, be formed integrally with the chain wheel axle or stepped axle 6. On the pivot pin 7 of the traction member 8, chain rollers or wheels 9 are rotatably journaled or mounted for supporting the step body 1 on guide rails 10. At each pivot pin 7, one link of the traction member 8 is rotatably journaled while another is fixed, causing the stepped axle or chain wheel axle 6 to follow angular displacements of the fixed link in operation. An entrainment pin 11.1 mounted at a projecting tread edge member 11 of the step body 1 engages the closed guide slot 4.2 of the rocker arm 4. The projecting tread edge member 11 is depressed or forced downwards by the force of a spring 12 and, outside the limits of a danger zone, is thereby held in a position flush with a step surface or tread 1.2. The spring 12 is supported on a support or bracket 1.3 mounted on the step body 1 and acts on a support or bracket 11.2 mounted on the projecting tread edge member 11. The projecting tread edge member 11 is guided in a parallel guide means 1.4 mounted substantially perpendicular to the step or tread surface 1.2 on the step body 1.

Figure 3:
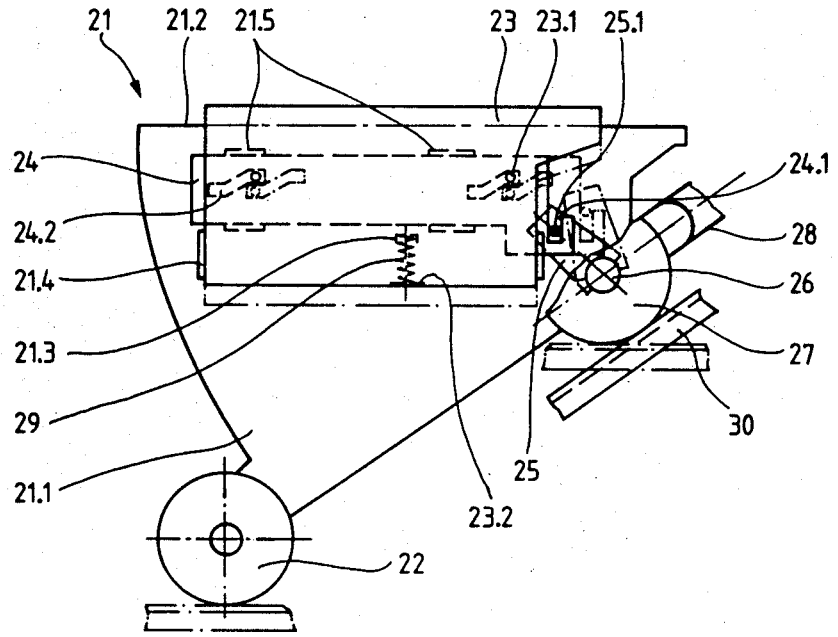
FIG. 3 schematically illustrates a side view of a modified embodiment of a step with laterally mounted projecting tread edge members.

In FIG. 3, a further embodiment of a step body for an escalator is labeled with the reference number 21. A step roller or drag wheel 22 is rotatably journaled or mounted on a lateral or side plate or wall 21.1 of the step body 21. Horizontal guideways 21.5 and vertical guideways 21.4 are also provided on the side wall 21.1. In the horizontal guideways 21.5, a sliding plate or cam plate 24 is translatably guided and in the vertical guideways 21.4, a projecting tread edge member 23 is translatably guided. The sliding plate or cam plate 24 possesses an open-ended guide slot 24.1 and two closed guide slots or cam slots 24.2. An entrainment pin or crank pin 25.1 mounted on a cam or crank arm 25 engages the open-ended guide slot 24.1. The cam or crank arm 25 is fixedly connected with a pivot or hinge pin 26 of a traction member 28 either directly or through a not particularly illustrated step axle similar to the step axle 6 of FIG. 1. Two entrainment pins 23.1 mounted on the projecting tread edge member 23 engage the closed guide slots or cam slots 24.2 of the sliding plate 24. The projecting tread edge member 23 is depressed or forced downwards by the force of a spring 29 and, beyond a danger zone, is held in a position flush with a step surface or tread surface 21.2 of the step body 21. The spring 29 is supported on a support or bracket 21.3 mounted on the step body 21 and acts upon a support or bracket 23.2 provided on the projecting tread edge member 23. A chain roller or wheel 27 running on a guide rail 30 is rotatably journaled or mounted on a pivot pin 26 of the traction member 28.

Figure 4:
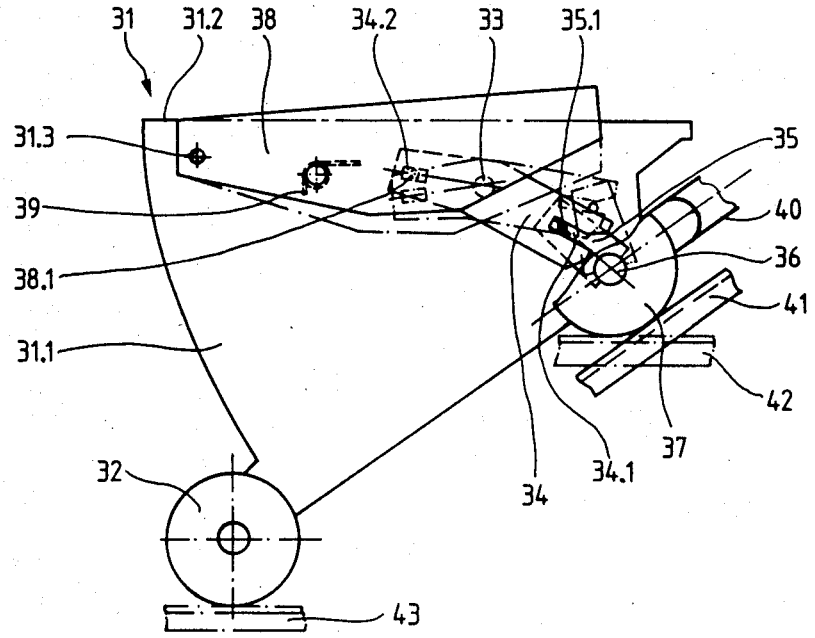
FIG. 4 schematically illustrates a side view of a further modified embodiment of a step with laterally mounted projecting tread edge members.

In FIG. 4, a further embodiment of a step body for an escalator is labeled with the reference number 31 which possesses a side wall or plate 31.1, a step surface or tread surface 31.2 and a swivel or pivot pin 31.3. A projecting tread edge member 38 is tiltingly or pivotably mounted or journaled on the swivel or pivot pin 31.3. By the force of a torsion spring 39 mounted on the projecting tread edge member 38, the projecting tread edge member 38 is, beyond a danger zone, held in a position flush with the step surface or tread surface 31.2. On the lateral or side plate or wall 31.1, a journal pin 33 is provided on which a rocker arm 34 is rotatably journaled or mounted. One end of the rocker arm 34 possesses an open-ended guide slot 34.1 and the other end of the rocker arm 34 possesses a closed guide slot 34.2. An entrainment pin or crank pin 35.1 mounted on a cam or crank arm 35 engages the open-ended guide slot 34.1. Again, the cam or crank arm 35 is fixedly connected with a pivot pin 36 of a traction member 40 either directly or through a not particularly illustrated step axle similar to the step axle 6 of FIG. 1. On the pivot pin 36, a chain roller or wheel 37 is rotatably journaled or mounted which supports the step body 31 on guide rails 41, 42 and 43 together with a step roller or drag wheel 32 also rotatably journaled or mounted on the step body 31. An entrainment pin 38.1 mounted on the projecting tread edge member 38 engages the closed guide slot 34.2 of the rocker arm 34.

Figure 5:
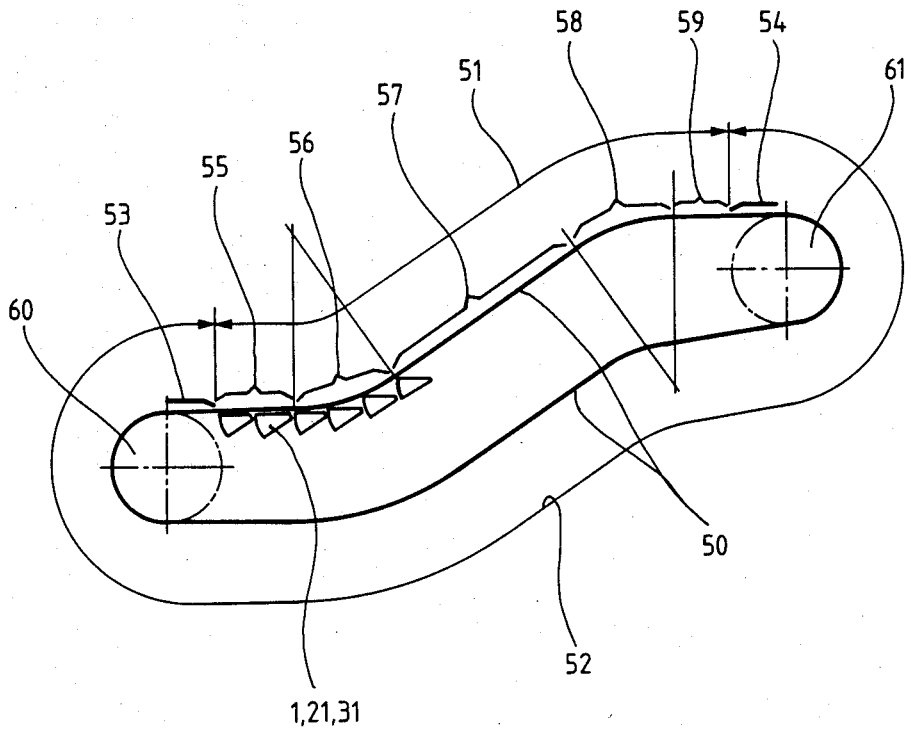
FIG. 5 schematically illustrates a sectional view of an escalator installation.

In FIG. 5, a forward run of an escalator step run 50 is labeled with the reference numeral 51 and a return run is labeled with the reference numeral 52. The forward run 51 extends between a lower comb plate 53 and an upper comb plate 54 and comprises a lower precursive level or substantially horizontal landing run 55, a lower transition curve 56, an inclined run 57, an upper transition curve 58 and an upper precursive level or substantially horizontal landing run 59. The endless escalator step run 50 turns at a lower reversing location 60 and at an upper reversing location 61. In the forward run 51 of the escalator step run 50, the steps 1, 21 and 31 move with a substantially constantly horizontal step surface or tread surface, whether ascending or descending the inclined run 57 or traveling through the landing runs 55 and 59.

The pivot pins 7, 26 and 36 of the traction members 8, 28 and 40 are fixedly connected with associated members, here links of the respective traction members 8, 28 and 40. In the same manner, the cams or crank arms 5, 25 and 35 are fixedly connected to the respective pivot pins 7, 26 and 36 either directly or through the stepped or chain wheel axle 6. The angle of attack of the cams or crank arms 5, 25 and 35 relative to the longitudinal axis of the traction members 8, 28 and 40 is thus always the same. The relative movement of the step body 1, 21 or 31 relative to the longitudinal axis of the traction member 8, 28 or 40 which serves to maintain the step surface or tread or tread surface 1.2, 21.2 or 31.2 of the step substantially constantly horizontal during the forward run of the escalator step run also causes a relative angular displacement between the step body 1, 21 or 31 and the cam or crank arm 5, 25 or 35. This displacement takes place in the region of the transition curves 56 and 58 between the inclined step run and the lower and upper horizontal step runs 55 and 59. The relative motion starts in the region of a horizontal run 55 or 59 and reaches a maximum value in the region of the inclined run 57. The entrainment pin or crank pin 5.1 or 35.5 mounted on the cam or crank arm 5 or 35 glides, according to FIGS. 1 and 4, into the open-ended guide slot 4.1 or 34.1 of the rocker arm 5 or 34 mounted on the step body 1 or 31. Here, the rocker arm 5 or 34 rotates around the pivot or journal pin 3 or 33 and tilts downwards on one side and upwards on the other side and forcibly moves or actuates the projecting tread edge member 11 or 38 through the entrainment pin 11.1 or 38.1 upwards or downwards relative to the step surface or tread or tread surface 1.2 or 31.2. Additionally, the force of the spring 12 or 39 acts constantly on the projecting tread edge member 11 or 38. By means of the spring 12 or 39, the projecting tread edge member 11 or 38 is constantly pulled toward the step surface or tread 1.2 or 31.2 of the step body 1 or 31 and the projecting tread edge member 11 or 38 is held in a position lying flush with the step surface or tread of the step body in the region of the horizontal run 55 or 59 of the forward run 51 as well as over the whole return run 52 of escalator step run 50. For example, with an escalator travelling upwards, each step appears out of the lower comb plate 53 with retracted tread edge members 11 or 38 lying flush with the step surfaces or treads and thus rolls over or glides through the lower horizontal run 55. As soon as the step surface or tread of the step rises from the region of the horizontal run 55 through the subsequent lower transition curve 56 into the region of the inclined run 57, the lateral tread edge members also rise gradually until they progress into the region of the inclined run 57 in a maximum projecting or extending manner at the end of the lower transition curve 56. In this position, the steps move along the region of the inclined run 57 and into the upper transition curve 58. The height of the extended or projecting tread edge members then decreases again until the steps run through the upper comb plate 54 after traveling through the upper region of the horizontal run 59 with the tread edge members flush with the step surface. While the projecting tread edge members are held in this flush position over the whole region of the return run by the force of the spring 12 or 39, the entrainment pin or crank pin 5.1 or 35.1 of the cam or crank arm 5 or 35 disengages from the open-ended guide slot 4.1 or 34.1 of the rocker arm 4 or 34 in the upper reversing position 61 in order to engage again in this open-ended guide slot 4.1 or 34.1 at the lower reversing position 60 at the end of the return run 52 before the step reaches the lower comb plate 53 again and starts a further revolution. In the same manner, the translation of the projecting tread edge members 11 or 38 occurs in reverse order in a downwardly travelling escalator.

Instead of the rocker arm 4 or 34 responsible for the movement of the projecting tread edge members described above and illustrated in FIGS. 1 and 4, the slide plate or cam plate 24 illustrated in FIG. 3 can be employed. By the relative displacement or translation of the cam or crank arm 25 relative to the step body 21, the sliding plate 24 is reciprocated for actuating the projecting tread edge member 23 upwards and downwards by means of the guide slots or cam slots 24.2 and the entrainment pins 23.1.

Instead of a translation of the projecting tread edge member parallel to the step surface or tread of the step, as is illustrated in FIGS. 1 and 3, an ascendantly prone translation of the projecting tread edge member can be provided as is illustrated in FIG. 4, or a not particularly illustrated descendantly prone translation of the projecting tread edge member can be provided.

It is furthermore possible to lengthen the projecting tread edge members illustrated in FIGS. 1, 3 and 4 and to extend the projecting tread edge members over the whole depth of the step.

It will be appreciated that the teachings of the invention can equally well be applied to horizontal transport means analogous or related to escalators, commonly known as moving sidewalks or walkways. While there is less danger of jamming in moving sidewalks or walkways, the means or facilities of the invention can advantageously prevent lateral scuffing. In such an application, there is no transition from a horizontal run to an inclined run and it is therefore necessary to exploit a different angular displacement between the step member and the traction means, namely that arising as the moving sidewalk or walkway leaves the turning region and enters its straight run. Since this angular displacement is of the reverse sense, the actuation means for extending and retracting the tread edge members must be correspondingly modified.

While there are shown and described present preferred embodiments of the invention, it is to be distinctly understood that the invention is not limited thereto, but may be otherwise variously embodied and practiced within the scope of the following claims.

Accordingly, what I claim is:

1. A step member for an escalator in which an escalator step run comprising a plurality of such step members and two continuous traction means is guided between two stationary skirt panels, comprising:

a step body having a tread surface, two lateral sides and at least one lateral side wall;

a respective tread edge member arranged at each of said two lateral sides and projecting above said tread surface;

each tread edge member of said respective tread edge members being movably mounted;

a spring means capable of exerting a force between said step body and said tread edge member;

the escalator defining a danger zone;

the step member being associated with a projecting safety position for the respective tread edge member;

the two continuous traction means having at least one pivot pin;

respective cam means mounted on each said at least one pivot pin;

a respective actuation means mounted on each said at least one lateral side wall;

said tread surface defining a flush position for said respective tread edge members;

said respective cam means and said respective actuation means holding each projecting tread edge member in said projecting safety position within said danger zone counter to said force;

each said projecting tread edge member being depressable into said flush position beyond said danger zone;

a journal pin mounted substantially perpendicular to said at least one lateral side wall;

said respective actuation means comprising a rocker arm pivotably journaled on said journal pin;

said rocker arm having a first end, a second end and an open-ended first guide slot at said first end and a closed guide slot at said second end;

a first entrainment pin arranged on said respective cam means for engaging said open-ended first guide slot; and a second entrainment pin arranged on said projecting tread edge member for engaging said closed guide slot.

2. A step member for an escalator in which an escalator step run comprising a plurality of such step members and two continuous traction means is guided between two stationary skirt panels, comprising:

a step body having a tread surface, two lateral sides and at least one lateral side wall;

a respective tread edge member arranged at each of said two lateral sides and projecting above said tread surface;

each tread edge member of said respective tread edge members being movably mounted;

a spring means capable of exerting a force between said step body and said tread edge member;

the escalator defining a danger zone;

the step member being associated with a projecting safety position for the respective tread edge member;

the two continuous traction means having at least one pivot pin;

respective cam means mounted on each said at least one pivot pin;

a respective actuation means mounted on each said at least one lateral side wall;

said tread surface defining a flush position for said respective tread edge members;

said respective cam means and said respective actuation means holding each projecting tread edge member in said projecting safety position within said danger zone counter to said force;

each said projecting tread edge member being depressable into said flush position beyond said danger zone;

the escalator has a direction of travel;

said tread surface defines a plane extending substantially perpendicular thereto;

said actuation means comprises a sliding plate;

said sliding plate being guided on said step body in said direction of travel in said plane;

said sliding plate having an open-ended guide slot and at least one closed guide slot;

a guide pin arranged on said projecting edge member;

a first entrainment pin arranged on said respective cam means for engaging said open-ended guide slot; and a second entrainment pin arranged on said guide pin for engaging said at least one closed guide slot.

3. The step member as defined in claim 1, wherein:

said projecting tread edge member comprises at least one rib.

4. The step member as defined in claim 2, wherein:

said tread surface defines a plane extending substantially perpendicular thereto; and means for translatably guiding each said projecting tread edge member parallel to said tread surface in said plane.

5. The step member as defined in claim 1, wherein:

said tread surface defines a plane extending substantially perpendicular thereto; and means for pivotably journaling each said projecting tread edge member in said plane.

6. The step member as defined in claim 1, wherein:

said tread surface has a predetermined depth;

said projecting tread edge member having a predetermined length; and said predetermined depth being at least as great as said predetermined length.

7. A step member for an escalator in which an escalator step run comprising a plurality of such step members and two continuous traction means is guided between two stationary skirt panels, comprising:

a step body having a tread surface, two lateral sides and at least one lateral side wall;

a respective tread edge member arranged at each of said two lateral sides and projecting above said tread surface;

each tread edge member of said respective tread edge members being movably mounted;

a spring means capable of exerting a force between said step body and said tread edge member;

the escalator defining a danger zone;

the step member being associated with a projecting safety position for the respective tread edge member;

the two continuous traction means having at least one pivot pin;

respective cam means mounted on each said at least one pivot pin;

a respective actuation means mounted on each said at least one lateral side wall;

said tread surface defining a flush position for said respective tread edge members;

said respective cam means and said respective actuation means holding each projecting tread edge member in said projecting safety position within said danger zone counter to said force;

each said projecting tread edge member being depressable into said flush position beyond said danger zone;

a stepped axle mounted on said at least one pivot pin and fixed against rotation relative thereto; and said respective cam means being mounted on said stepped axle.

* * * * *